US010006423B2

(12) United States Patent
Abbas

(10) Patent No.: US 10,006,423 B2
(45) Date of Patent: Jun. 26, 2018

(54) AUTOMOTIVE FUEL PUMP

(71) Applicant: Hitachi Automotive Systems Americas Inc., Harrodsburg, KY (US)

(72) Inventor: Jason Abdulghani Abbas, Martin, OH (US)

(73) Assignee: Hitachi Automotive Systems Americas Inc., Harrodsburg, KY (US)

( * ) Notice: Subject to any disclaimer, the term of this patent is extended or adjusted under 35 U.S.C. 154(b) by 398 days.

(21) Appl. No.: 14/640,389

(22) Filed: Mar. 6, 2015

(65) Prior Publication Data

US 2016/0258402 A1 Sep. 8, 2016

(51) Int. Cl.
*F02M 59/10* (2006.01)
*F02M 59/02* (2006.01)
(Continued)

(52) U.S. Cl.
CPC ..... *F02M 59/025* (2013.01); *F02M 59/367* (2013.01); *F02M 59/462* (2013.01); *F02M 59/466* (2013.01); *F02M 63/005* (2013.01); *F04B 7/0076* (2013.01); *F04B 11/00* (2013.01); *F04B 11/0016* (2013.01);
(Continued)

(58) Field of Classification Search
CPC ..... F04B 7/0076; F04B 7/02; F04B 7/0266; F04B 11/00; F04B 11/0033; F04B 11/0008; F04B 11/0016; F04B 39/0033; F04B 39/005; F04B 39/0055; F04B 39/0061; F04B 49/03; F04B 49/035; F04B 49/22; F04B 49/24; F04B 49/243; F04B 53/102; F04B 53/1022; F04B 53/103; F04B 53/1032; F04B 53/1035; F04B 53/1002; F04B 53/1005; F04B 53/1007; F04B 53/14; F04B 53/16; F04B 59/102; F04B 53/10; F02M 59/025; F02M 59/367; F02M 59/462; F02M 59/102; F02M 63/0054; F02M 59/466; F02M 37/0017; F02M 37/0041; F02M 55/0004; F02M 55/04; F02M 2200/858; F02M 63/005; F02M 2200/31; F02M 2200/315; F16K 31/0651; F16K 31/0606; F16K 47/04; F16K 47/08; F16K 47/12
USPC ..... 251/117, 126, 129.21, 129.5, 129.01, 251/129.09
See application file for complete search history.

(56) References Cited

U.S. PATENT DOCUMENTS 4,465,439 A * 8/1984 Seino ..... F02M 37/043 417/417
5,248,132 A * 9/1993 Jung ..... D06F 37/20 267/35
(Continued)

*Primary Examiner* — Bryan Lettman
*Assistant Examiner* — Charles W Nichols
(74) *Attorney, Agent, or Firm* — Mattingly & Malur, PC

(57) ABSTRACT

An automotive fuel pump having a body with an inlet, an outlet, and an elongated chamber therebetween. A relief valve, relief valve housing, and check valve are respectively disposed in the chamber between the inlet and the outlet. The relief valve housing has a portion which extends across the chamber so that a first axial end of the relief valve housing forms a valve seat for the check valve while the other axial end forms a valve seat for the relief valve. The check valve permits fluid flow from the body chamber to the outlet while the relief valve exhausts excess fluid pressure at the outlet back into the body chamber.

20 Claims, 7 Drawing Sheets

(51) Int. Cl.

| | |
|---|---|
| ***F04B 11/00*** | (2006.01) |
| ***F04B 53/10*** | (2006.01) |
| ***F04B 7/00*** | (2006.01) |
| ***F02M 59/46*** | (2006.01) |
| ***F02M 59/36*** | (2006.01) |
| *F02M 63/00* | (2006.01) |

(52) U.S. Cl.
CPC ..... *F04B 53/10* (2013.01); *F04B 53/1002* (2013.01); *F04B 53/1032* (2013.01); *F02M 59/102* (2013.01); *F02M 63/0054* (2013.01); *F02M 2200/31* (2013.01); *F02M 2200/315* (2013.01)

(56) References Cited

U.S. PATENT DOCUMENTS

| | | | | |
|---|---|---|---|---|
| 6,213,094 | B1 * | 4/2001 | Onishi | F02M 59/462 123/447 |
| 7,604,462 | B2 * | 10/2009 | Inoue | F04B 1/0408 417/439 |
| 8,132,558 | B2 | 3/2012 | Lucas et al. | |
| 8,202,065 | B2 | 6/2012 | Siegel et al. | |
| 2012/0227711 | A1 * | 9/2012 | Saito | F02M 55/04 123/506 |
| 2012/0251366 | A1 | 10/2012 | Kuroyanagi et al. | |

* cited by examiner

AUTOMOTIVE FUEL PUMP

BACKGROUND OF THE INVENTION

I. Field of the Invention

The present invention relates generally to liquid fuel pumps and, more particularly, to such a pump for an automotive vehicle.

II. Description of Related Art

Many automotive vehicles utilize direct injection internal combustion engines due to the efficiency in fuel economy achieved by such engines. In a direct injection engine, the fuel is injected directly into the combustion chambers or cylinders for the engine.

Since the fuel is injected directly into the engine cylinders, the fuel supply must necessarily be provided at a high pressure sufficient to overcome the pressures existing within the interior of the combustion chambers. Typically, a fuel pump supplies fuel from a source of fuel, such as a fuel tank, to a high pressure fuel injection rail. The fuel injection rail is then fluidly connected to the individual fuel injectors that are mounted on the engine block. The opening and closing timing for each fuel injector for the engine is then controlled by an electronic control system for the vehicle.

The previously known fuel pumps for direct injection engines contribute significantly to the overall cost of the fuel system as well as the amount of room consumed by the fuel pump. Typically, the pump body is made of stainless steel which is an expensive material both to obtain and machine. Furthermore, tight engine packaging also often causes a concern for the placement of the pump.

These previously known pumps are also complex in construction and include numerous internal components. The numerous internal components not only increase the overall cost and expense of the pump, but also create more potential failure modes for the pump. This, in turn, creates more expensive quality control measures due to increased safety concerns over the design, quality, and durability of the multiple parts contained within the fuel pump.

The previously known fuel pumps for direct injection engines are also highly susceptible to contamination of the fuel. Such contamination can entangle in the pump's critical components and render the pump inoperable or otherwise compromised.

The high susceptibility to contamination of these prior pumps results primarily from the complex passageways formed through the pump housing between the inlet and the outlet. Furthermore, because of the complexity of the fuel flow passageways, there oftentimes is limited fuel flow around these components which makes them difficult to fully clean from the fuel flow.

SUMMARY OF THE PRESENT INVENTION

The present invention provides a liquid fuel pump that is particularly suitable for use with a direct injection internal combustion engine which overcomes these previously known disadvantages of the prior pumps.

In brief, the fuel pump of the present invention comprises an elongated body having an inlet adjacent one end and an outlet adjacent the other end. An elongated and generally cylindrical chamber is formed between the inlet and the outlet.

A relief valve, a relief valve housing, and a check valve are respectively disposed in the chamber between the inlet and the outlet. The relief valve housing includes a portion which extends across the body chamber so that fluid flow between the inlet and the outlet can only occur through passageways formed through the relief valve housing.

The check valve is movable between an open position to enable fuel flow from the body chamber and to the outlet, and a closed position in which the check valve prevents fluid flow from the outlet back into the body chamber.

Similarly, the relief valve is movable between an open position which enables fluid flow from the outlet into the chamber, and a closed position in which such flow is prevented. The relief valve only opens when the pressure at the outlet exceeds a predetermined threshold. Resilient members, such as springs, urge the check valve and relief valve towards their respective closed positions.

In order to create pressurized fuel in the body chamber, a cylinder is mounted in the body chamber between the relief/inlet valve assembly and the inlet to the body. This cylinder includes at least one, and preferably several, passageways which enable fuel flow through the cylinder between the inlet and the body chamber.

One face of the cylinder forms a valve seat for an inlet valve for the pump. An inlet valve which cooperates with the valve seat is mounted within the body chamber and movable between an open position, in which fluid flows from the inlet, through the cylinder, and into the body chamber, and vice versa, and a closed position in which such flow is precluded.

In order to actuate the inlet valve between an open and a closed position, a solenoid coil is disposed annularly around the housing adjacent the inlet valve. The inlet valve is preferably mounted to an anchor made of a solid magnetic material to enhance the flow of magnetic flux from the solenoid coil to the inlet valve. A nonmagnetic separator is also positioned around the housing radially aligned with the solenoid coil. This separator serves to channel the magnetic flux from the solenoid coil to both the anchor and the inlet valve.

A resilient member, such as a spring, urges the inlet valve to either its open or its closed position. Energization of the solenoid coil then moves the inlet valve against the force of the resilient member towards the other of its open or closed positions.

A plunger is slidably mounted within a receiving bore formed through the cylinder. This plunger is then reciprocally driven by a cam rotatably driven by the internal combustion engine. Thus, by timing the opening and closing of the inlet valve with the reciprocation of the plunger, the plunger inducts fuel from the inlet into the body chamber, and vice versa, when the inlet valve is open, and pressurizes fuel within the body chamber when the inlet valve is closed during its power stroke to provide metered pressurized fuel through the check valve and into the fuel rail for the engine.

In order to reduce pressure pulsations within the fuel system, and thus lessen the noise and fatigue resulting from such pressure pulsations, a pressure dampener is preferably provided around the cylinder. This pressure dampener includes both an inner and an outer shell which are hermetically sealed together to form a closed chamber between the shells. A plurality of helical ribs are then formed on at least one of the shells which permits expansion and compression of the pressure dampener in both the axial and radial directions. Such compression and expansion of the dampener lessens the pressure pulsations within the fuel pump. Furthermore, the helical design of the ribs on at least one of the shells creates turbulence within the fuel flow and facilitates cleaning of any contaminates that may be within the fuel system by fuel flow through the pump.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE INVENTION

Figure 1:
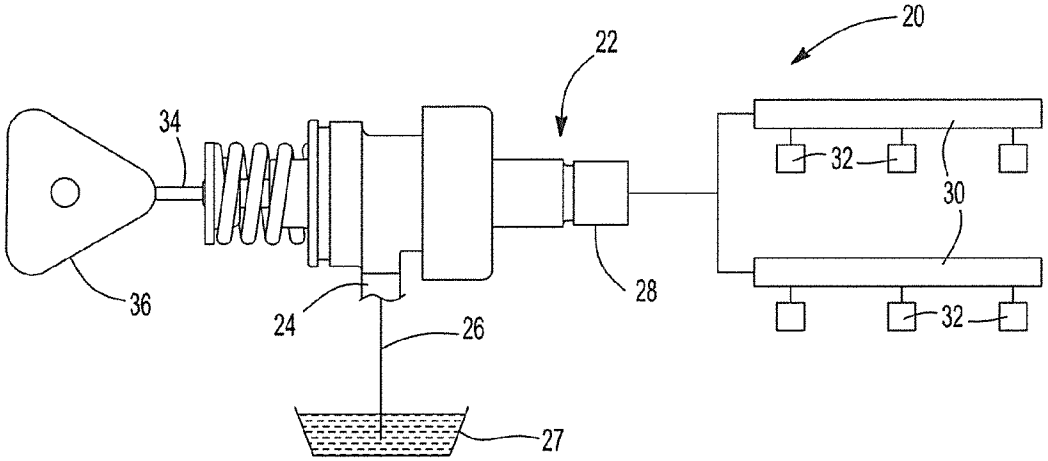
FIG. 1 is a diagrammatic view illustrating the fuel pump mounted in a fuel system for an automotive vehicle.

With reference first to FIG. 1, a diagrammatic view of a fuel system 20 for an automotive vehicle is shown. The automotive vehicle utilizes liquid fuel, such as gasoline, and preferably has a direct injection internal combustion engine.

Consequently, the fuel system 20 includes a fuel pump 22 with a fuel inlet 24 fluidly connected by a fuel supply line 26 to a fuel source, such as a fuel tank 27. A fuel pump outlet 28 is then fluidly connected to one or more fuel rails 30 which contain pressurized fuel during the operation of the fuel system 20. Fuel injectors 32, such as a direct injection fuel injector, are then fluidly connected to the rails 30.

In order to supply pressurized fuel to the fuel rails 30, the fuel pump 22 includes a plunger 34 which is reciprocally driven by a cam 36 to create the pressurized fuel for the fuel rails 30.

Figure 2:
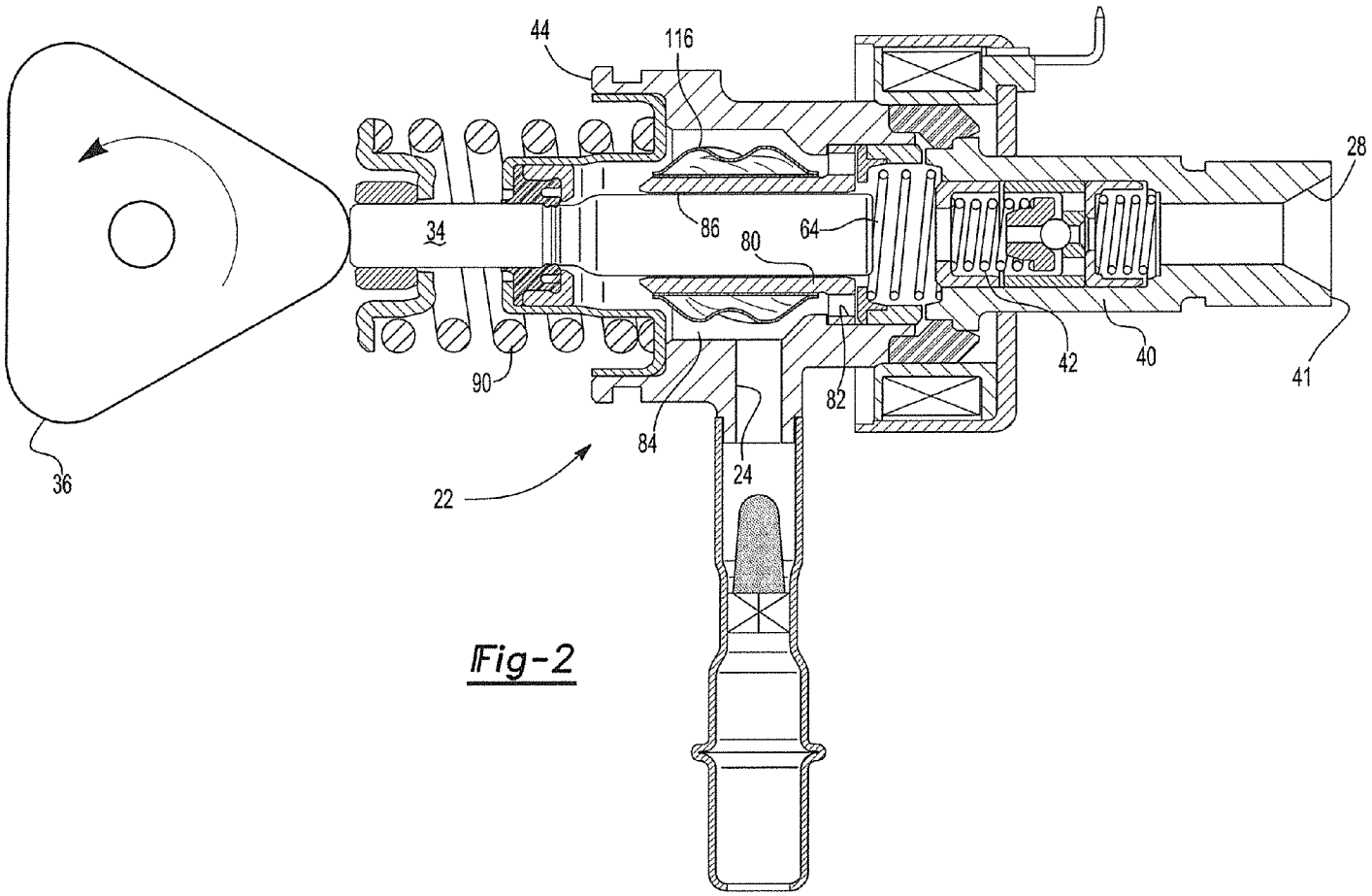
FIG. 2 is a longitudinal sectional view illustrating the fuel pump.
Figure 4:
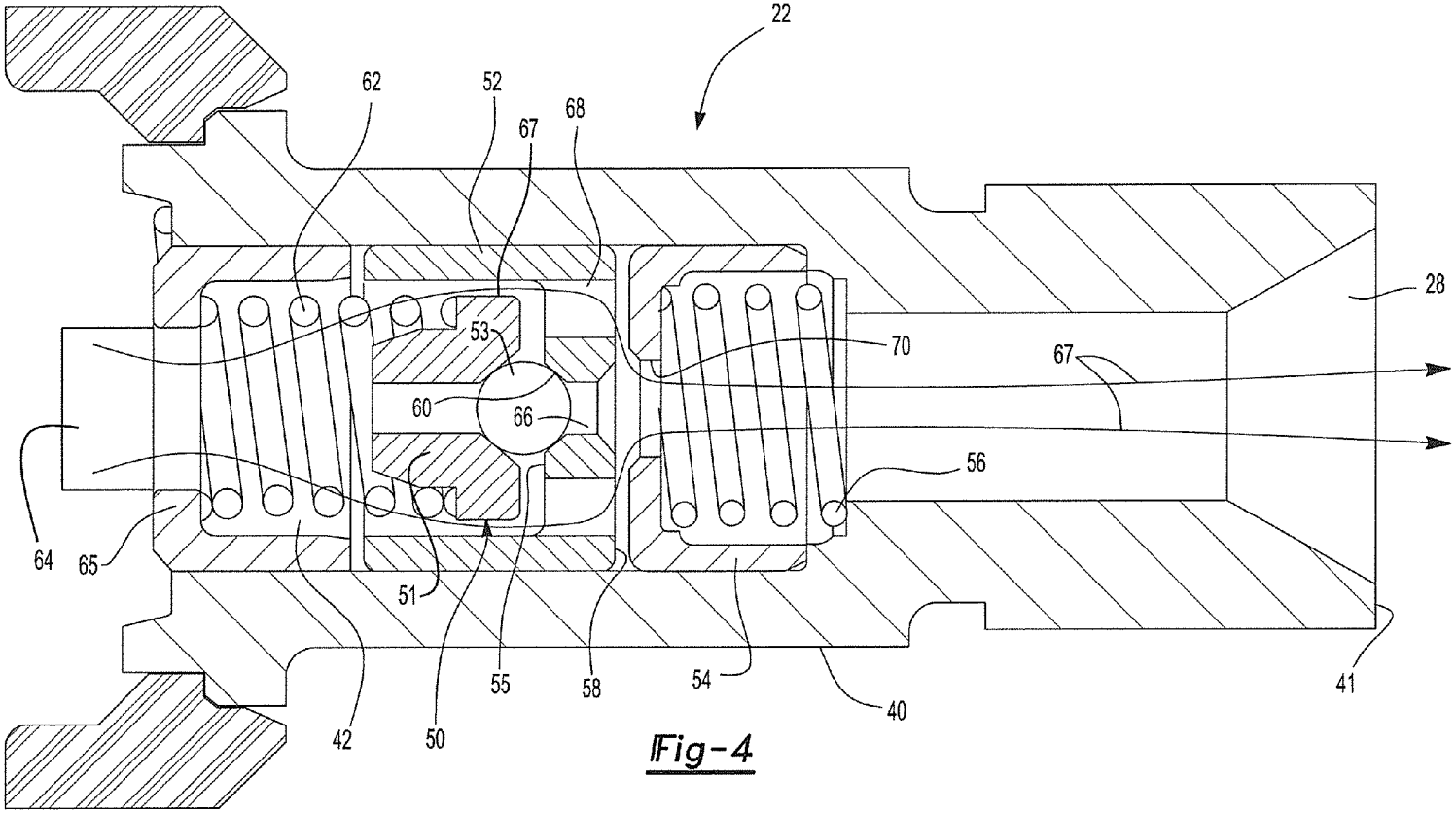
FIG. 4 is a longitudinal sectional view illustrating the operation of the check valve.

With reference now to FIGS. 2 and 4, the fuel pump 22 is shown in greater detail and includes an elongated and generally cylindrical body 40. The body 40 defines an elongated and generally cylindrical body chamber 42 between the outlet 28 at one end 41 of the body 40 and an opposite end 44 (FIG. 2) of the body 40. The fuel pump inlet 24 is fluidly connected to this body chamber 42 adjacent the end 44 of the body 40.

Figure 5:
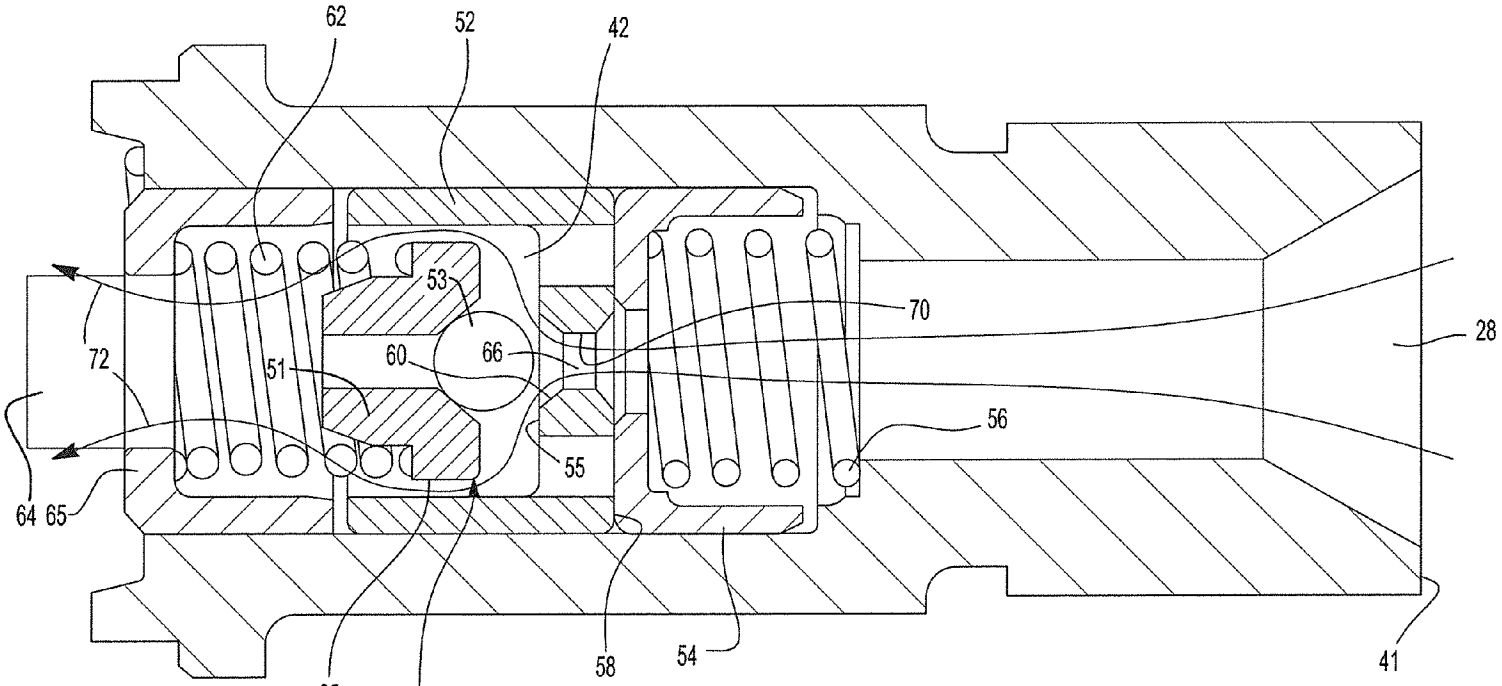
FIG. 5 is a longitudinal sectional view of the relief valve in an open position.

With reference now to FIGS. 4 and 5, a relief valve 50, which includes a relief valve member 51 and ball 53, a relief valve body 52, and a check valve 54 are respectively disposed within the body chamber 42 between the inlet 24 and outlet 28 with the check valve 54 positioned closest to the outlet 28. A resilient member 56, such as a helical spring, urges the check valve 54 towards its closed position (FIG. 5) against one axial end 58 of the relief valve body 52 so that the end forms a valve seat 58 for the check valve 54. A valve seat 60 for the relief valve 50 is also formed on the relief valve body 52 on an axial end surface 55 opposite from the axial end 58 of the relief valve body 52. A resilient member 62, such as a compression spring, is mounted in between a spring retainer 65 and the relief valve 50 to urge the relief valve 50 against its valve seat 60.

Figure 3:
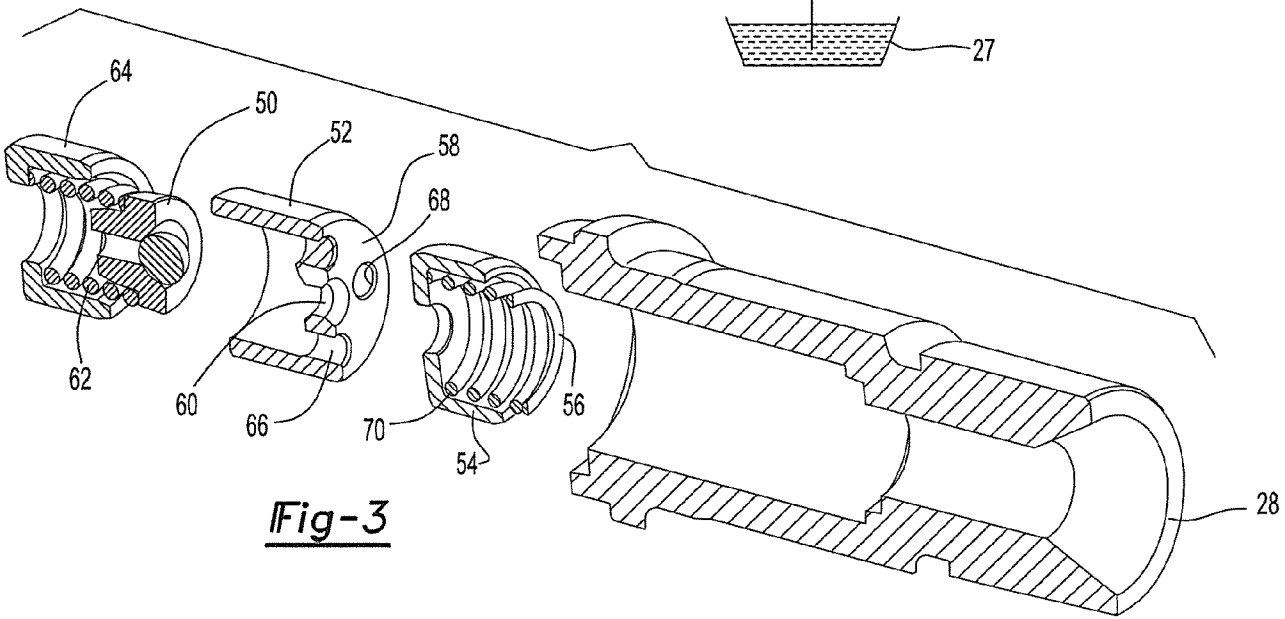
FIG. 3 is an exploded view of the relief/inlet valve assembly.

With reference now to FIGS. 3 and 4, the relief valve body 52 extends substantially entirely across the body chamber 42. Consequently, fluid flow through the relief valve body 52 can only occur through either a central port 66 or one or more outer radial ports 68 formed through the relief valve body 52.

With reference now particularly to FIG. 4, during operation of the pump, high pressure fuel is provided to a pump chamber 64 (illustrated only diagrammatically) which is in fluid communication with the relief valve 50. During a high pressure portion of the pump cycle, this high pressure fuel is communicated around an outer periphery 67 of the relief valve 50 and through the radial ports 68 in the relief valve body 52 as shown by arrows 67. This pressure then forces the check valve 54 to unseat from its valve seat 58 on the relief valve body 52. When this occurs, fluid flow is established through the radial ports 68 and a central port 70 on the check valve 54 thus allowing fluid flow from the pump chamber 64, past the relief valve 50, and through the check valve 54 to the outlet 28 for the fuel pump 22. Conversely, when the pressure within the pump chamber 64 is insufficient to overcome the force of the resilient member 56 and move the check valve 54 away from its valve seat 58, e.g. during a fuel intake portion of the pump cycle, the spring 56 moves the check valve 54 against its valve seat 58 thus closing the check valve port 70. In doing so, reverse flow from the pump outlet 28 to the pump chamber 64 is precluded provided the relief valve 50 remains in a closed position.

With reference now to FIG. 5, during certain engine operating conditions, such as a rapid deceleration, excessive pressure may build up within the fuel rails 30 (FIG. 1). For proper operation of the fuel system 20, this excess pressure must be relieved.

With reference then to FIG. 5, during periods of excessive pressure within the fuel rails, this excessive pressure is communicated through the check valve port 70 and through the central port 66 of the relief valve body 52 to the relief valve 50. When the pressure exceeds a predetermined threshold, the relief valve 50 will shift away from its seat against the force of its resilient member 62 thus opening the central port 66 in the relief valve body 52. This allows fuel flow from the outlet 28 through the check valve port 70 and relief valve port 66 and around the relief valve 50 to the pump chamber 64 as shown by arrows 72. When the pressure at the outlet 28 falls below the predetermined threshold necessary to open the relief valve 50, the relief valve resilient member 62 urges the relief valve 50 against its valve seat 60 to its closed position as shown in FIG. 4 thus terminating the fluid flow from the fuel rails 30 and into the pump chamber 64.

With reference again to FIG. 2, in order to pressurize the pump chamber 64 with pressurized fuel, an elongated cylinder 80 is mounted within the body chamber adjacent the inlet 24. This cylinder 80 includes one or more through passageways 82 which enable fluid flow from an inlet chamber 84 to the pump chamber 64. The inlet 24 to the fuel pump is fluidly connected to the inlet chamber 84.

The cylinder 80 includes an axial throughbore 86 in which the elongated plunger 34 is axially slidably mounted. This plunger 34 is then reciprocally axially driven by the cam 36 against the force of a plunger spring 90.

Figure 6:
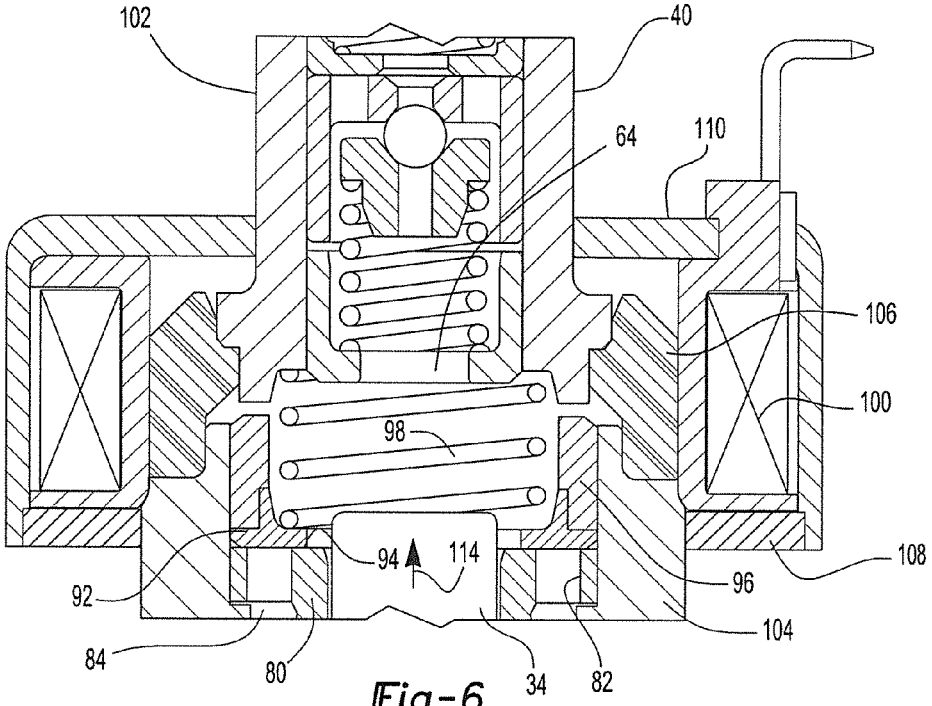
FIG. 6 is a longitudinal sectional view of the solenoid valve assembly with the inlet valve in a closed position.

With reference now particularly to FIG. 6, an inlet valve 92 cooperates with a valve seat 94 formed on the cylinder 80 to selectively open and close the cylinder passageways 82 and thus control the fluid flow between the inlet chamber 84 and pump chamber 64. The inlet valve 92 is preferably constructed of a hardened magnetic material to withstand repeated impacts against the valve seat 94 on the cylinder 80. However, to improve the magnetic responsiveness of the inlet valve 92, the inlet valve 92 is preferably fixedly mounted to an anchor 96 constructed of a magnetic material. As shown, a compression spring 98 urges the inlet valve 92 against its seat 94 and thus towards its closed position. However, the opposite may be alternatively true, i.e. the spring 98 may urge the valve 92 towards its open position.

In order to actuate the valve, a solenoid coil 100 is disposed annularly around the pump body 40 and so that the magnetic coil 100 is preferably generally radially aligned with a portion of the valve anchor 96.

The housing 40 preferably includes an upper housing part 102 containing the check valve and relief valve assemblies and a lower housing part 104 which contains the plunger 34 and pump inlet 24. Both housing parts 102 and 104 are constructed of a magnetic material. However, a flux separator 106, constructed of a non-magnetic material, is disposed in between and connects the upper housing part 102 to the lower housing part 104. This flux separator 106, together with housing yokes 108 and 110 on opposite axial ends of the solenoid coil 100, channel the magnetic flux from the solenoid coil 100 around the flux separator 106 and through the valve anchor 96 to effectively and efficiently magnetically couple the solenoid coil 100 to the inlet valve 92.

Figure 7:
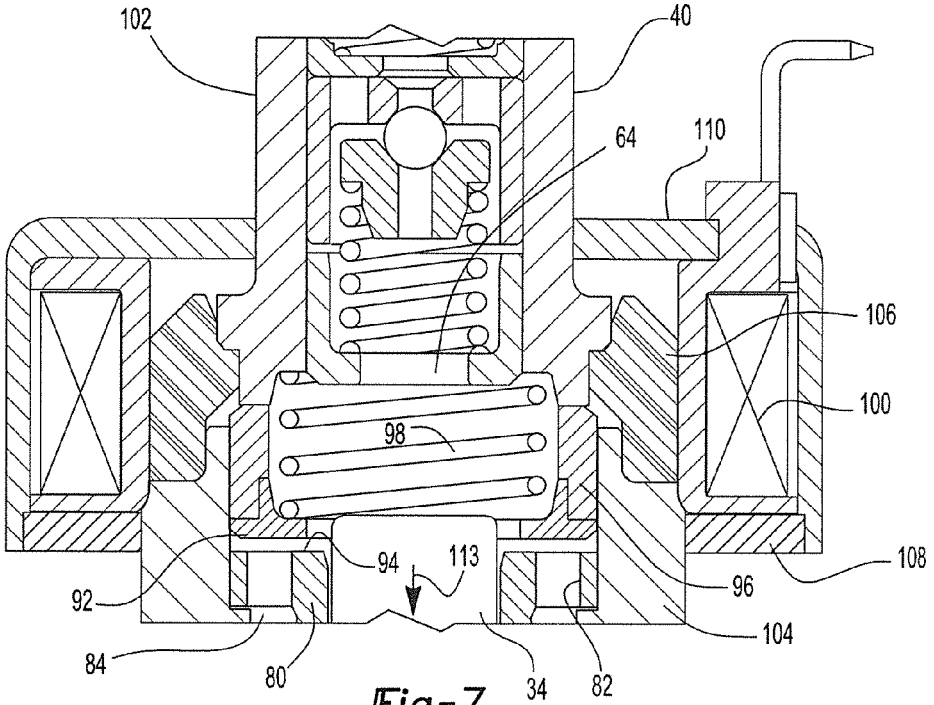
FIG. 7 is a view similar to FIG. 6, but illustrating the inlet valve in an open position.

During the operation of the inlet valve 92, the opening and closure of the inlet valve by the solenoid coil 100 is timed with the reciprocation of the plunger 34 in the cylinder 80. Specifically, as shown in FIG. 7 the inlet valve 92 is open during the intake stroke of the plunger 34 by hydraulic force, i.e. during the retraction of the plunger 34 from the pump chamber 64 as indicated by arrow 113. This plunger retraction inducts fuel from the inlet chamber 84 (FIG. 2) into the pump chamber 64.

Figure 10:
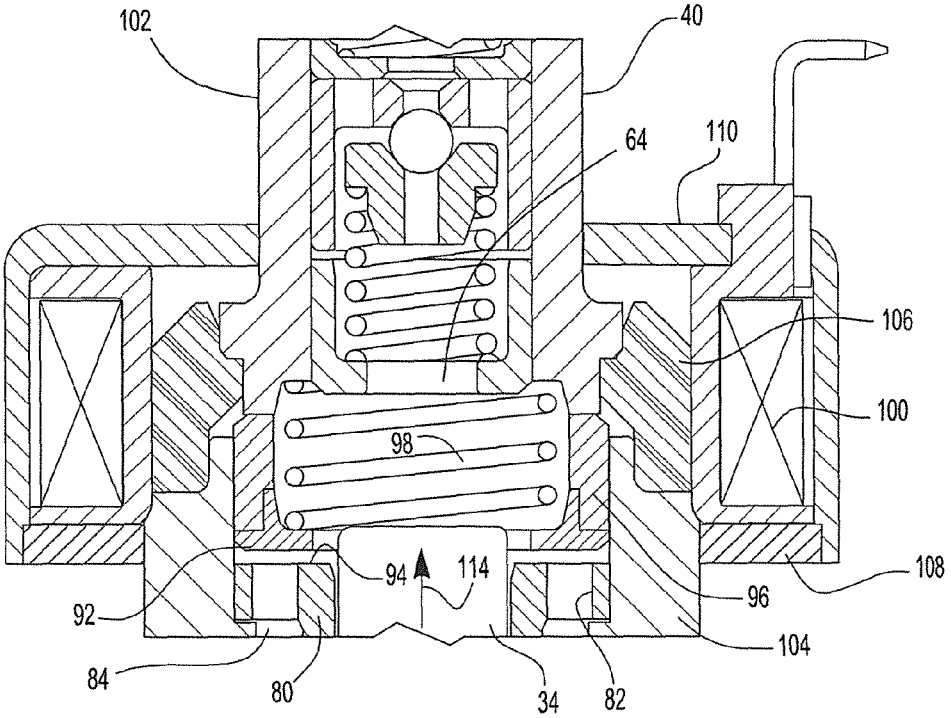
FIG. 10 is a view similar to FIG. 7 but showing the inlet valve in a spill condition.

With reference to FIG. 10, the solenoid coil 100 is then activated as the plunger 34 axially moves into the pump chamber 64 as shown by arrow 114. The activation of the solenoid coil 100 allows the inlet valve 92 to remain in its open position, allowing fluid to return from the pumping chamber 64 to the inlet chamber 84. Consequently, the amount of fluid able to be pumped to the fuel rails 30 by the inward movement of the plunger 34 into the pump chamber in the direction of arrow 114 is limited by the duration of time the solenoid coil 100 remains activated, allowing metered control of fluid from the pumping chamber 64 to the fuel rails 30.

With reference to FIG. 6, the solenoid coil 100 is then deactivated as the plunger 34 axially moves into the pump chamber 64 as shown by arrow 114. The deactivation of the solenoid coil 100 allows the solenoid spring 98 to return the inlet valve 92 to its closed position. Consequently, the inward movement of the plunger 34 into the pump chamber in the direction of arrow 114 pressurizes the pump chamber 64 and this pressurized fluid opens the check valve 54 and provides pressurized fuel to the fuel rails 30 in the previously described fashion. This inward movement of the plunger 34 also inducts fuel from the fuel source 27 into the inlet chamber 84 (FIG. 2).

The reciprocation of the plunger 34 in the pump body 22 can cause unwanted pressure pulsations within the overall fuel system. These pressure pulsations can, in turn, cause fatigue and unwanted noise, especially at low engine speeds.

Figure 8:
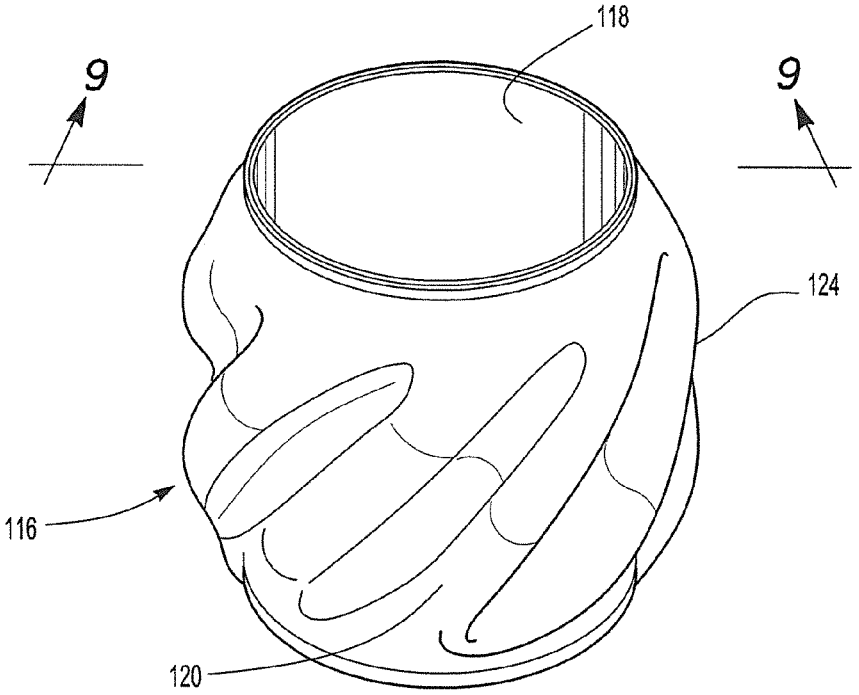
FIG. 8 is an elevational view illustrating a pressure dampener.
Figure 9:
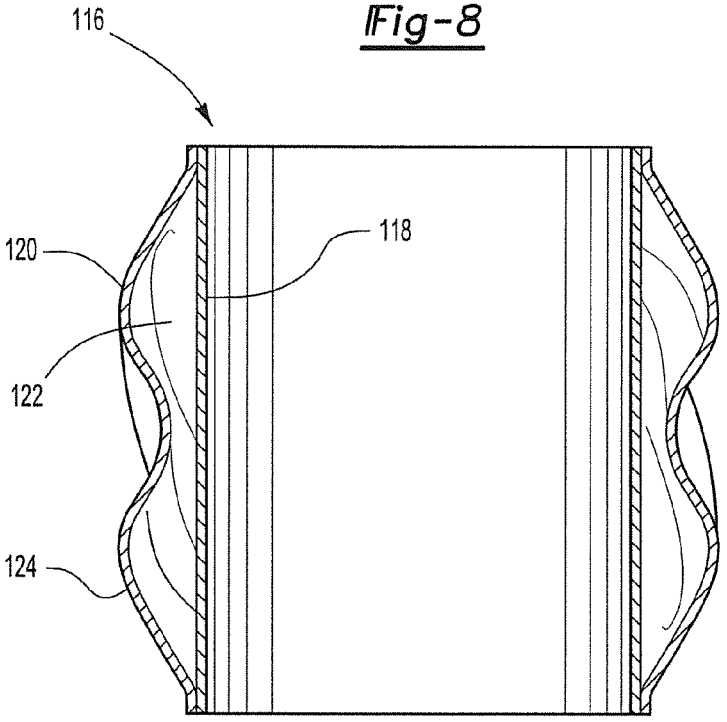
FIG. 9 is a longitudinal sectional view of the pressure dampener taken along line 9-9 in FIG. 8.

With reference then to FIGS. 2, 8, and 9, a pressure dampener 116 is preferably provided within the inlet chamber 84 around the cylinder 80 to dampen these pressure pulsations. The pressure dampener 116 includes an inner shell 118 and an outer shell 120 which are hermetically sealed together to form a closed interior dampener chamber 122 (FIG. 9). The shells 118 and 120 may be constructed of any suitable flexible material, such as thin metal.

At least one of the shells 118 and 120 includes a plurality of helical ribs 124. These helical ribs 124 serve two purposes. First, they permit the shells to expand and contract in both a radial as well as a longitudinal direction to absorb the pressure pulsations in the fuel system. Secondly, the helical ribs 124 create turbulence within the inlet chamber 84 and wash away any contaminates that may have entered the fuel pump.

From the foregoing, it can be seen that the present invention provides a fuel pump which is particularly suitable for a direct injection internal combustion engine which achieves several advantages. First, since the fuel flow through the fuel pump is essentially a straight line from the inlet chamber and to the fuel pump outlet, the possibility of contaminates within the fuel flow system becoming entrapped within the fuel pump is minimized. This, in turn, results in higher reliability and durability for the fuel pump.

Applicant's use of a single relief valve body 52 to form the valve seat for both the check valve 54 as well as the relief valve 50 reduces the number of components for the overall pump thus increasing reliability. Similarly, the provision of the cylinder 80 which forms both the valve seat for the inlet valve 92 as well as the support for the pump plunger also minimizes the number of components within the fuel pump.

Applicant's construction of the inlet valve assembly with the solenoid coil 100 which annularly surrounds the valve and is directly magnetically coupled to the valve also not only simplifies the overall construction of the fuel pump, but also achieves efficient and effective opening and closing of the inlet valve.

The pressure dampener also provides two separate functions, namely the dampening of the pressure pulsations in the pump as well as creating turbulence in the fuel flow to clear out contaminates. This, in turn, reduces pump failures which may otherwise occur through such contaminates in the fuel.

Having described my invention, many modifications thereto will become apparent to those skilled in the art to which it pertains without deviation from the spirit of the invention as defined by the scope of the appended claims.

I claim:

1. A pump comprising:

a body having an inlet, an outlet and a chamber between the inlet and the outlet;

a relief valve, a relief valve housing and a check valve respectively disposed in the chamber between the inlet and the outlet, the relief valve housing having a portion extending across the chamber, a first axial side of the relief valve housing portion forming a valve seat for the check valve and a second axial side of the relief valve housing portion forming a valve seat for the relief valve;

said check valve movable between an open position to enable fluid flow from the chamber into the outlet and a closed position;

a first spring which urges the check valve towards the closed position, the relief valve movable between an open position to enable fluid flow from the outlet into the chamber and a closed position;

a second spring which urges the relief valve towards the closed position;

a pump member which supplies pressurized fuel from the inlet to the outlet; and a pressure dampener disposed around the pump member within a fluid flow path within the chamber, the pressure dampener having an outer shell sealed to an inner shell forming an annular chamber around the pump member, the pressure dampener being expandable and contractible in at least a radial direction to absorb pressure pulsations within the chamber.

2. The pump as defined in claim 1 wherein the first and second springs respectively urge the check valve and the relief valve in opposite axial directions toward the relief valve housing portion.

3. The pump as defined in claim 1 wherein the relief valve housing portion includes a port which registers with a port in the check valve.

4. The pump as defined in claim 1 wherein the pump member comprises a cylinder and a reciprocating piston within the cylinder.

5. The pump as defined in claim 4 further comprising:

an inlet valve movable between an open position to establish fluid communication from a source of fuel to the chamber and a closed position; and a solenoid which actuates the inlet valve between the open and the closed position in synchronism with reciprocation of the piston.

6. The pump as defined in claim 5 wherein:

the piston is reciprocally mounted in the cylinder;

the cylinder is attached to the body, and an end of the cylinder forms a seat for the inlet valve.

7. The pump as defined in claim 1 wherein the pressure dampener is disposed in an inlet chamber portion of the chamber surrounding a cylinder of the pump member.

8. The pump as defined in claim 1 wherein the annular chamber of the pressure dampener includes an elongated annular chamber filled with a compressible material.

9. The pump as defined in claim 8 wherein:

the compressible material comprises a gas; and the outer shell comprises a flexible sheet material.

10. The pump as defined in claim 1 wherein the pressure dampener includes at least one outwardly protruding rib protruding outward from the outer shell sufficiently far into a fluid flow path within the chamber to create turbulence within the fluid flow path.

11. The pump as defined in claim 10 wherein the at least one outwardly protruding rib is arranged in a helical pattern around the outer shell of the dampener.

12. The pump as defined in claim 1 wherein the pressure dampener is annular in shape.

13. The pump as defined in claim 12 wherein:

the inlet extends radially with respect to the chamber; and the pressure dampener is aligned with the inlet.

14. The pump as defined in claim 4 wherein the pressure dampener is disposed around and is mounted on the cylinder.

15. A fuel pump comprising:

an elongated body having a chamber, an inlet to the chamber, and an outlet from the chamber;

a cylinder having an inlet valve seat which extends across the chamber between the inlet and the outlet, the inlet valve seat having at least one through passageway;

an inlet valve movable between an open position to permit fluid flow through the through passageway and a closed position to stop fluid flow through the through passageway;

a solenoid coil disposed around the housing adjacent the inlet valve which, upon energization, moves the inlet valve from one of the open and closed positions to the other of the open and closed positions; and a pressure dampener disposed around the cylinder within a fluid flow path within the chamber, the pressure dampener having an outer shell forming an annular chamber that extends around the cylinder, the pressure damper being expandable and contractible in at least a radial direction to absorb pressure pulsations within the chamber.

16. The fuel pump as defined in claim 15 further comprising a spring which urges the inlet valve from one of the open and closed positions to the other of the open and closed positions.

17. The fuel pump as defined in claim 15 wherein:

the inlet valve is attached to an anchor made of a magnetic material; and the solenoid coil is radially aligned with the anchor.

18. The fuel pump as defined in claim 17 wherein the body comprises a lower body part, an upper body part and a non-magnetic flux separator positioned between the upper and lower body parts, the flux separator positioned in radial alignment with the solenoid coil so that the flux separator directs magnetic flux from the solenoid coil through the anchor.

19. A fuel pump comprising:

a pump housing including a chamber with an inlet and an outlet;

a cylinder within the chamber;

a piston reciprocally movable in the cylinder for pumping fluid from the inlet to the outlet; and a pressure dampener disposed around the cylinder within a fluid flow path within the chamber, the pressure dampener including:

an inner cylindrical shell disposed around the cylinder, an outer annular shell sealed to the inner shell and forming a closed annular chamber between the inner shell and the outer shell, and at least one rib protruding outward from the outer shell sufficiently far into a fluid flow path within the chamber to create turbulence within the fluid flow path, wherein the pressure dampener is expandable and contractible in at least a radial direction to absorb pressure pulsations within the chamber.

20. The fuel pump as defined in claim 19 wherein the outer shell is constructed from a flexible sheet having a plurality of the ribs protruding outwardly from the outer shell in a helical configuration.

* * * * *